343-909 SR
10/14/80 OR 4,228,437

United States Patent [19]
Shelton

[11] 4,228,437
[45] Oct. 14, 1980

[54] WIDEBAND POLARIZATION-TRANSFORMING ELECTROMAGNETIC MIRROR

[75] Inventor: J. Paul Shelton, Arlington, Va.

[73] Assignee: The United States of America as represented by the Secretary of the Navy, Washington, D.C.

[21] Appl. No.: 52,298

[22] Filed: Jun. 26, 1979

[51] Int. Cl.³ ..... H01Q 15/24
[52] U.S. Cl. ..... 343/909
[58] Field of Search ..... 343/756, 909, 753, 754, 343/755

[56] References Cited

U.S. PATENT DOCUMENTS 3,754,271 8/1973 Epis ..... 343/909

*Primary Examiner*—Eli Lieberman
*Attorney, Agent, or Firm*—R. S. Sciascia; Philip Schneider; Vincent Ranucci

[57] ABSTRACT

A reflecting mirror for transforming the polarization of electromagnetic (EM) waves independently of the frequency of the waves and, thus, over an arbitrarily wide RF bandwidth includes two interleaved sets of planar arrays of resonant elements, both being orthogonally polarized, and each set comprising layers of the arrays which are arranged so that the layered elements of each set form a log-periodic configuration. The difference in phase between the reflection coefficient functions of the first and second sets of arrays is independent of the frequency of EM waves. Each of the arrays resonates at a different frequency and the arrays resonate over the frequency band of operation. A plane EM wave, the polarization of which has two vector components, strikes the mirror on the array having the shortest strips. The two polarization components of the wave travel into the mirror. Each component is reflected as it encounters strips of an array having a resonance which matches the resonant frequency of the component. The components being non-parallel to each other are reflected from different arrays which causes the components to change in phase relative to each other, thereby transforming the polarization of the wave.

3 Claims, 5 Drawing Figures

WIDEBAND POLARIZATION-TRANSFORMING ELECTROMAGNETIC MIRROR

BACKGROUND OF THE INVENTION

This invention relates generally to reflectors for transforming the polarization of EM waves and more particularly to a log-periodic, three-dimensional lattice reflector for transforming the polarization of EM waves independently of the frequency of the waves and, therefore, over a wide bandwidth of operation.

The polarization of a plane EM wave is a vector and thus comprises two vector components. Existing polarization-transforming reflectors use polarization-sensitive structures such as wire grids, parallel-plate arrays, or inhomogeneous dielectric configurations. These structures are arranged so that the reflective path for one of the two vector components of a polarized wave has a different length than that of the second vector component. This difference in the reflective path lengths of the two components results in a difference in phase between the two components of a reflected EM wave. This phase-difference causes the polarization of an incident wave to be transformed into a different polarization when the wave is reflected. A disadvantage of this technique is that the path-length difference is related to the wavelength and, thus, is sensitive to the frequency of a polarized wave. Therefore, existing reflectors cannot operate over a wide bandwidth of frequency.

This disadvantage is significant, for example, as it applies to antennas for radar systems on naval vessels. because of the wide RF bandwidth among such radars, each of many such radars has its own dedicated antenna. This invention provides a means, for example, for conducting signals over a wide bandwidth from many radars to one antenna, thereby reducing the number of antennas on naval vessels.

SUMMARY OF THE INVENTION

The general purpose and object of the present invention is to transform the polarization of EM waves into any desirable type of polarization independently of the frequency of a signal. This and other objects of the present invention are accomplished by a reflecting mirror comprising two interleaved sets of layered planar arrays, each array having a regular lattice of parallel, resonant elements, the arrays of one set being alternately layered with the arrays of the other set, the layered elements of each set forming a log-periodic configuration, and the elements of each set being perpendicular to the elements of the other set so that the sets are orthogonally polarized.

Each set has a reflection coefficient function which varies essentially linearly with the logarithm of frequency. The difference in phase between the reflection coefficient functions of the two sets of arrays is constant with frequency. This phase-difference between the reflection-coefficient functions causes the polarization of an incident wave to transform upon reflection of the wave. The phase difference is a function of the scale factor from a polarized array of one set to the next succeeding polarized array of the other set, and is not a function of the difference between the reflective path lengths of the components of polarization. Therefore, the polarization-transformation properties of the invention are not sensitive to wavelength or frequency.

The log-periodic, three-dimensional configuration of interleaved horizontally and vertically polarized arrays is a novel feature of the reflecting mirror.

The advantage of the invention is that a polarization of EM waves may be transformed into another type of polarization over an arbitrarily wide bandwidth. Thus, the invention provides a frequency-independent solution to a problem, for example, of requiring a dedicated antenna for each radar system on naval vessels.

Other objects and advantages of the invention will become apparent from the following detailed description of the invention when considered in conjunction with the accompanying drawing wherein:

DETAILED DESCRIPTION OF THE INVENTION

Figure 1:
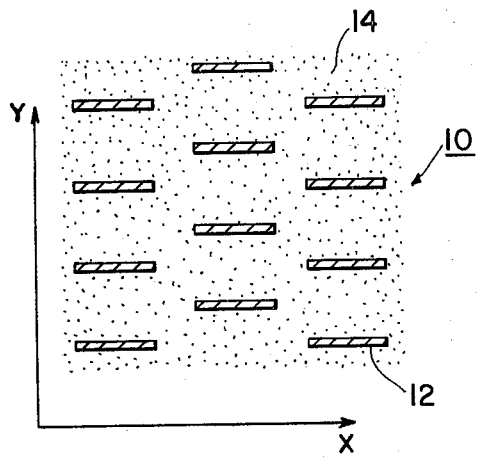
FIGS. 1 and 2 illustrate planar arrays of resonant electrically conductive strips or wires in the X—Y plane.

Referring now to the drawings, wherein like reference characters designate like or corresponding parts throughout the several views, FIG. 1 shows a planar array 10 in the X—Y plane which array comprises a regular lattic of identical resonant elements 12, as, for example, strips or wires made of an electrically conductive material such as copper. The array 10 is not limited to the lattice shown in FIG. 1 but may comprise any regular lattice whose elements 12 are positioned under the same principles as the radiating elements of any phased array. In addition, the array may include any appropriate number of elements. The array may be formed by any suitable method such as photo-etching the elements on a typical dielectric such as foam 14.

Figure 2:
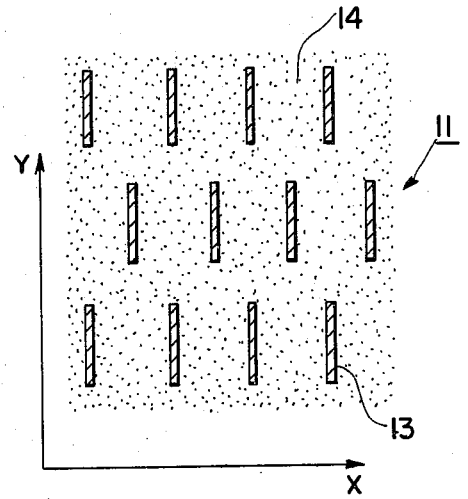

FIG. 2 illustrates a planar array 11 in the X—Y plane which array includes the same regular lattice as any lattice selected for the array 10 of FIG. 1 except that the lattice of FIG. 2 is shifted 90°. For purposes of explanation the elements 12 of FIG. 1 are referred to as X-polarized and the elements 13 of FIG. 2 are referred to as Y-polarized.

Figure 3:
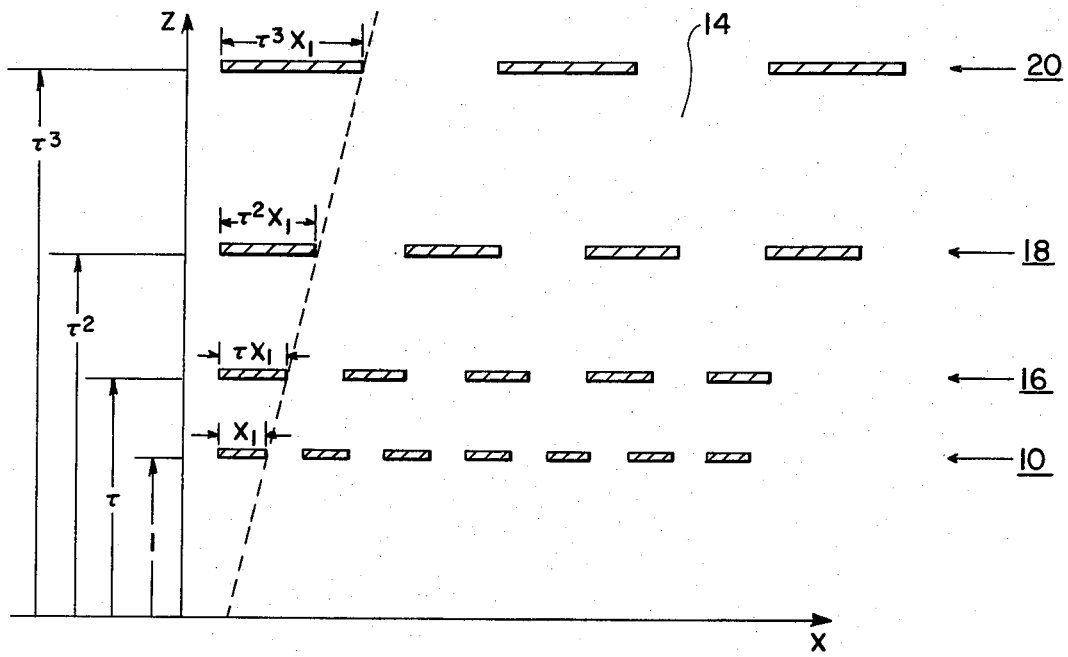
FIG. 3 shows a cross-section in the X—Z plane of a set of arrays, such as and including the array of FIG. 1, which are layered in a log-periodic configuration.

FIG. 3 shows a cross-section in the X—Z plane of a set of layered arrays 10, 16, 18, 20 having foam 14 between successive layers, where the arrays 16, 18, 20 include the same regular lattice as any lattice selected for the array 10. Arrays 10, 16, 18, 20 are layered and spaced apart in the Z direction according to a logarithmic function where $X_1$ is the length of the smallest elements, that is, those of array 10, and $\tau$ is a scale factor, or the ratio of the distances in the Z direction, between any two adjacent arrays having parallel elements and $\tau$ is greater than one. The significance of $\tau$ will be discussed subsequently.

Figure 4:
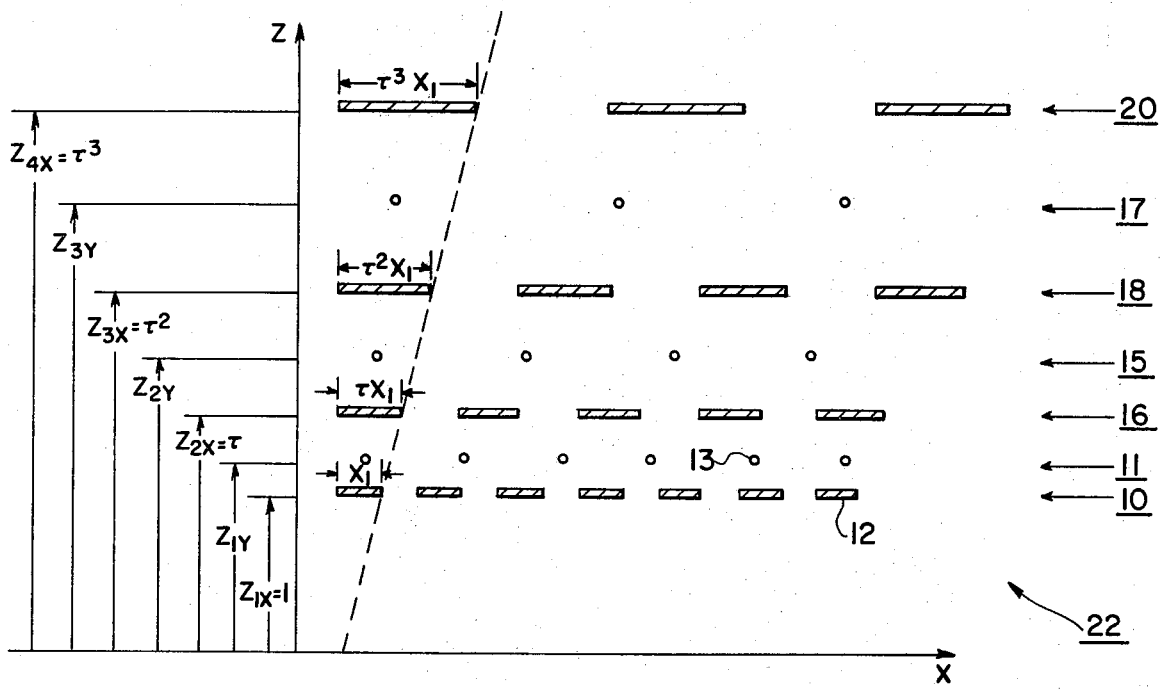
FIG. 4 illustrates a cross-section in the X—Z plane of the invention having a set of arrays which are layered in a log-periodic configuration, as shown in FIG. 3, and which are interleaved with a second set of log-periodic layered arrays, such as and including the array of FIG. 2.

The invention 22 is shown in FIG. 4 in the X—Z plane and includes two interleaved sets of arrays such as the arrays shown in FIGS. 1 and 2, each set having elements formed in a log-periodic configuration, as shown in FIG. 3, and one set being polarized perpendicular to the other set, that is, the elements of each set being perpendicular to the elements of the other set. Arrays and sets of arrays comprising X- and Y-polarized elements may be expressed as X- and Y-polarized arrays and sets of arrays respectively for purposes of explanation. Four arrays 10, 16, 18, 20 of X-polarized elements and three arrays 11, 15, 17 of Y-polarized elements are shown in FIG. 4 for illustrative purposes.

Each array has a specific resonance which depends on the length of the elements of the array. Since resonance is required throughout the frequency band of operation for X- and Y-polarization, the number of arrays is determined by the frequency bandwidth over which a reflecting mirror must operate. The layered structure of a mirror, however, must comprise alternating layers of X- and Y-polarized arrays. A mirror may have an equal number of X- and Y-polarized arrays, or may include one more Y-polarized array, or as shown in FIG. 4, one more X-polarized array. It is also shown by arrays 11, 15 and 17 of FIG. 4 that the elements of an array need not be directly above or below, in the Z direction, the parallel elements of another array. As mentioned previously, what is required is that the elements of each set of arrays be layered in a log-periodic configuration, and the layers be alternately orthogonally polarized.

Figure 5:
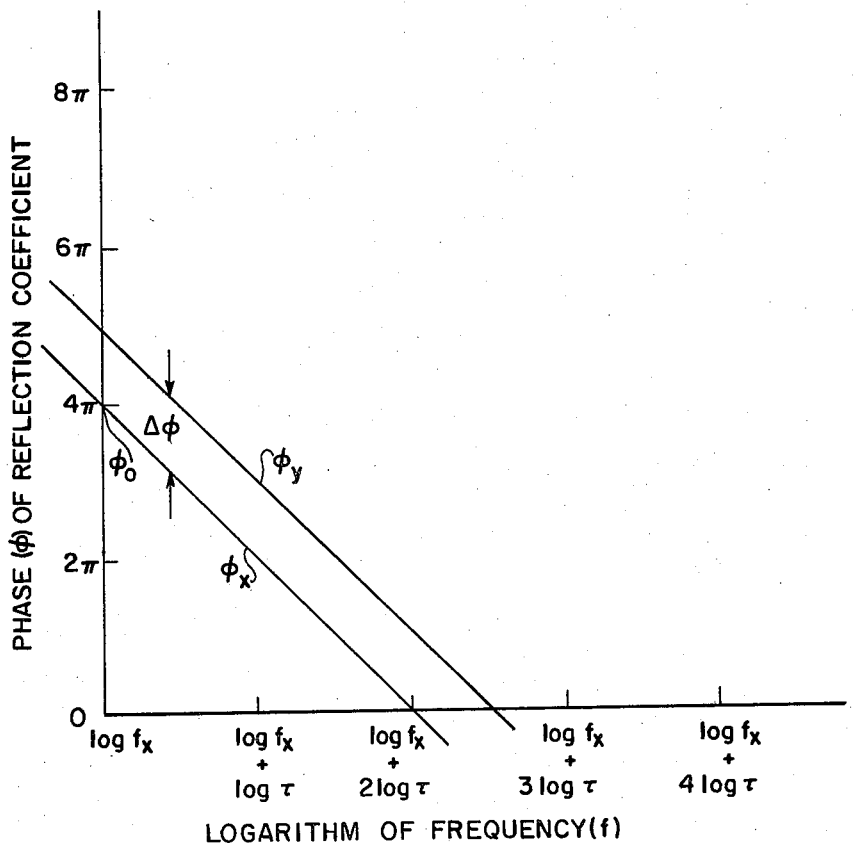
FIG. 5 is a graph illustrating the variation of phase with the logarithm of frequency for the reflection coefficient function of each set of arrays shown in FIG. 4.

The operation of a three-dimensional, log-periodic lattice, such as that shown in FIG. 4, is analogous to the operation of log-periodic electrical circuits as described in "Log-Periodic Transmission-Line Circuits—Part I", by R. H. DuHamel and M. E. Armstrong, IEEE Trans. MTT, Vol. MTT-14, No. 6, June 1966, pp. 264–274. A polarized plane EM wave enters the structure shown in FIG. 4 on the side having the smallest elements, that is, along the positive Z direction from the bottom of FIG. 4. The wave travels into the structure until the wave encounters resonant elements where the wave is reflected. The reflection coefficient of the structure is theoretically unity, that is, the structure reflects the entire wave. However, the two sets of arrays (orthogonally polarized) have reflection coefficient functions as shown in FIG. 5 where X and Y denote orthogonally polarized sets of arrays, respectively. Each function indicates that the phase $\phi$ of the reflection coefficient of each set of arrays varies essentially linearly with the logarithm of frequency (f) as follows:

$$\phi_x=\phi_o-(2\pi/\log\rho)\log(f/f_x) \quad (1a)$$

$$\phi_y=\phi_o-(2\pi/\log\rho)\log(f/f_y) \quad (1b)$$

where f is the frequency of the wave, $f_x$ and $f_y$ are the resonant frequencies of an X- and Y-polarized array respectively, and $\phi_o$ is a constant.

If the difference in Phase $\Delta\phi$ between the reflection coefficient functions is not dependent on the frequency (f) of a wave, the mirror can perform over a wideband of frequency.

The arrays are interleaved and each array has a different resonant frequency. The difference in phase between reflection coefficients of X- and Y-polarized arrays is from Eq. (1a) and (1b):

$$\begin{aligned}\Delta\phi &= \phi_y-\phi_x=(2\pi/\log\tau)\log(f/f_x) \\ &= 2\pi\log(f_x/f_y)/\log\tau\,.\end{aligned} \quad (2)$$

Therefore, the phase difference between reflection coefficients of X- and Y-polarized arrays is independent of the frequency (f) of a polarized wave. This is the basis for the wideband operation of the invention.

The factor which determines the type of polarization transformation that a mirror provides, i.e., horizontal linear-to-vertical linear, linear-to-circular, etc., is the scale factor, or ratio of the distances along the positive Z axis of FIG. 4 between adjacent orthogonally polarized arrays, that is, $Z_{1y}/Z_{1x}$, $Z_{2x}/Z_{1y}$, $Z_{2y}/Z_{2x}$, etc. Since the X-polarized and Y-polarized elements are arranged in a log-periodic configuration, the lengths of the X- and Y-polarized elements are proportional to the distance in the Z direction of the elements. Thus the lengths of the Y-polarized elements may be expressed as $Z_{1y}Y_1$ for array 11, $Z_{2y}Y_1$ for array 15, and $Z_{3y}Y_1$ for array 17. The following relationships exist:

$$\begin{aligned}&X_1\sim Z_{1x}\\ &Y_1\sim Z_{1y}\\ &Y_1/X_1=Z_{1y}/Z_{1x}\end{aligned} \quad (3)$$

A resonant frequency $f_o$ is inversely proportional to the length of a resonant element of an array as follows:

$$f_x\sim 1/X_1$$

$$f_y\sim 1/Y_1$$

and from Eq. (4)

$$f_x/f_y=Y_1/X_1=Z_{1y}/Z_{1x} \quad (4)$$

For a half-wave plate, or a twist reflector, which transforms waves of horizontal linear polarization to waves of vertical linear polarization, and vice-versa, $\Delta\phi=180°$ or $\pi$, and Eq. (2) becomes $$\log(f_x/f_y)=\tfrac{1}{2}\log\tau$$

$$f_x/f_y=(\tau)^{\frac{1}{2}}=Z_{1y}/Z_{1x}.$$

Since $Z_{1x}=1$, $Z_{2x}=\tau$, $Z_{3x}=\tau^2$ and $Z_{4x}=\tau^3$, then $Z_{1y}=\tau^{\frac{1}{2}}$, $Z_{2y}=\tau^{3/2}$, and $Z_{3y}=\tau^{5/2}$ in FIG. 4 for a half-wave plate, and the scale factor, or ratio of the distances along the positive Z axis between adjacent X- and Y-polarized arrays is $$\tau^{\frac{1}{2}}.$$

For a quarter-wave plate or circularly polarizing mirror, which requires that $\Delta\phi=90°$ or $\pi/2$, Eq. (2) becomes $$f_x/f_y=(\tau)^{\frac{1}{4}},$$

and $Z_{1y}=\tau^{\frac{1}{4}}$, $Z_{2y}=\tau^{5/4}$, and $Z_{3y}=\tau^{9/4}$ in FIG. 4.

In the aforementioned manner a polarization-transforming mirror, which operates independently of frequency, may be made by selecting the required change in phase between the X- and Y-polarizaions for a desirable transformation and determining the ratio of the distances between adjacent X- and Y-polarized arrays.

Obviously many more modifications and variations of the present invention are possible in light of the above teachings. It is therefore to be understood that within the scope of the appended claims the invention may be practiced otherwise than as specifically described.

What is claimed and desired to be secured by Letters Patent of the United States is:

1. A reflecting mirror for transforming the polarization of incident electromagnetic waves independently of the frequency of the waves and over an arbitrarily wide frequency bandwidth, comprising:

two interleaved sets of planar arrays of resonant elements, the two sets being orthogonally polarized, the arrays of the first set being alternately layered with the arrays of the second set, the layered elements of each set being spaced apart according to a logarithmic function, each set having a reflection coefficient function which varies approximately linearly with the logarithm of frequency, the difference in phase $\Delta\phi$ between the reflection coefficient functions of each set being essentially constant with change in frequency, said difference in phase being a function of the scale factor between adjacent arrays of dissimilar polarization and being defined by $$\Delta\phi = 2\pi \log (f_x/f_y)/\log \tau$$

where $f_x$ is a resonant frequency of an array of the first set, $f_y$ is a resonant frequency of an array of the second set, the arrays applicable to $f_x$ and $f_y$ being adjacent, $\tau$ represents the scale factor between adjacent arrays of similar polarization, and $f_x/f_y$ represents the scale factor between adjacent arrays of dissimilar polarization.

2. The reflecting mirror as recited in claim 1 wherein each of said arrays comprises a regular lattice of parallel resonant elements.

3. The reflecting mirror as recited in claim 2 wherein each array resonates at a different frequency.

* * * * *